United States Patent [19]

Anttila et al.

[11] Patent Number: 4,708,192

[45] Date of Patent: Nov. 24, 1987

[54] CASTING LINE MELT SUPPLY DEVICE

[75] Inventors: Einar Anttila; Kare Folgerö, both of Västerås, Sweden

[73] Assignee: ASEA Aktiebolag, Västerås, Sweden

[21] Appl. No.: 865,287

[22] Filed: May 21, 1986

[30] Foreign Application Priority Data

May 22, 1985 [SE] Sweden ..... 8502507

[51] Int. Cl.[4] ..... B22D 5/04; B22D 37/00

[52] U.S. Cl. ..... 164/323; 164/337

[58] Field of Search ..... 164/322, 323, 335, 337

[56] References Cited

U.S. PATENT DOCUMENTS

| | | | |
|---|---|---|---|
| 862,364 | 2/1907 | Williams | 164/323 |
| 1,156,446 | 10/1915 | Taylor et al. | 164/335 |
| 2,522,031 | 9/1950 | Gavin, Sr. | 164/337 |
| 3,435,882 | 4/1969 | Falk | 164/337 |
| 3,489,101 | 1/1970 | Kennedy | 164/335 |
| 3,996,996 | 12/1976 | Gunnergaard | 164/323 |
| 4,156,452 | 5/1979 | Sharkey | 164/335 |
| 4,230,308 | 10/1980 | Gueguen | 164/335 |
| 4,549,600 | 10/1985 | Kauserud | 164/323 |

*Primary Examiner*—Nicholas P. Godici
*Assistant Examiner*—Samuel M. Heinrich
*Attorney, Agent, or Firm*—Watson, Cole, Grindle & Watson

[57] ABSTRACT

The invention relates to an apparatus for simultaneous casting of at least two casting moulds or balls. The apparatus comprises a carriage which is movable in the direction of a casting line and is provided with two gutters for transferring molten metal from respective furnace spouts to respective sprues. At least one of these gutters is adjustable in the longitudinal direction of the line.

6 Claims, 2 Drawing Figures

30
A
A
12
17
15
20
18
11
16
19
12
36
22
14
37
19
30
12
13
31

21
33
18
30
11
15
12
32
34
35
30
12
37
21

CASTING LINE MELT SUPPLY DEVICE

BACKGROUND OF THE INVENTION (1) Field of the Invention

The present invention relates to apparatus for enabling casting of at least two casting mould means, e.g., casting moulds or casting balls, at the same time.

(2) Description of the Related Art

Casting apparatus comprising a single mobile gutter or melt transfer device movable along a casting line is already known - see, for example, U.S. Pat. No. 1,156,446, issued on Oct. 12, 1915 to R. Taylor and L. A. Miley and Swedish Patent Application No. 8206437-9 (Published Application No. 440,752). In such known apparatus the casting line comprises a number of casting moulds moving continuously along the line. The gutter is mounted for movement back and forth along the line moving forwards with a particular casting mould to enable the mould to be filled with molten metal and moving backwards to the following casting mould ready for transferring melt to that mould when the gutter moves forward again. The gutter accompanies the different casting moulds, when moving in the forwards direction, with the aid of carrier means during tapping of molten metal from a furnace. Disadvantages of this known arrangement, however, are that the time required for casting is too short for each casting mould, the speed for obtaining sufficient casting is too high, and the moulds run the risk of being damaged.

The present invention aims to provide a solution to the above problems and other problems associated therewith.

SUMMARY OF THE INVENTION

Apparatus according to the invention is characterized in that it comprises a car or carriage means movable in the direction of a casting line, the carriage means being provided with two melt transfer devices for transferring melt from respective furnace spouts to respective casting sprues, at least one melt transfer device being adjustable in the direction of the line, e.g., the longitudinal direction of the line. This makes it possible to cast two casting moulds (balls) at a time while the moulds are moving. The result is that casting time is gained and/or that the time taken to cast molten metal into a mould can be increased, e.g., up to twice the time for each mould can be used, to achieve better cast moulds.

Casting can be performed along a so-called indexed casting line in which the casting mould moves during casting and is at a standstill during return movement of a melt transfer device. However, casting can also be performed along a continuous casting line. In an indexed casting line, casting of a casting mould is performed during part of a period of rest of the casting mould, during the subsequent movement of the casting mould and during the major part of the next period of rest of the casting mould.

The carriage means is suitably suspended by suspension means from spouts of the furnace and the furnace is suitably movably mounted in the transverse direction in relation to the line in order to adjust the melt transfer devices to the respective sprues. The carriage means is suitably provided with carrier means, which is intended to grip or engage a casting mould or casting ball during movement along the line.

BRIEF DESCRIPTION OF THE DRAWING

The invention will now be described in greater detail, by way of example, with reference to the accompanying drawing, in which.

DESCRIPTION OF THE PREFERRED EMBODIMENT

Figure 1:
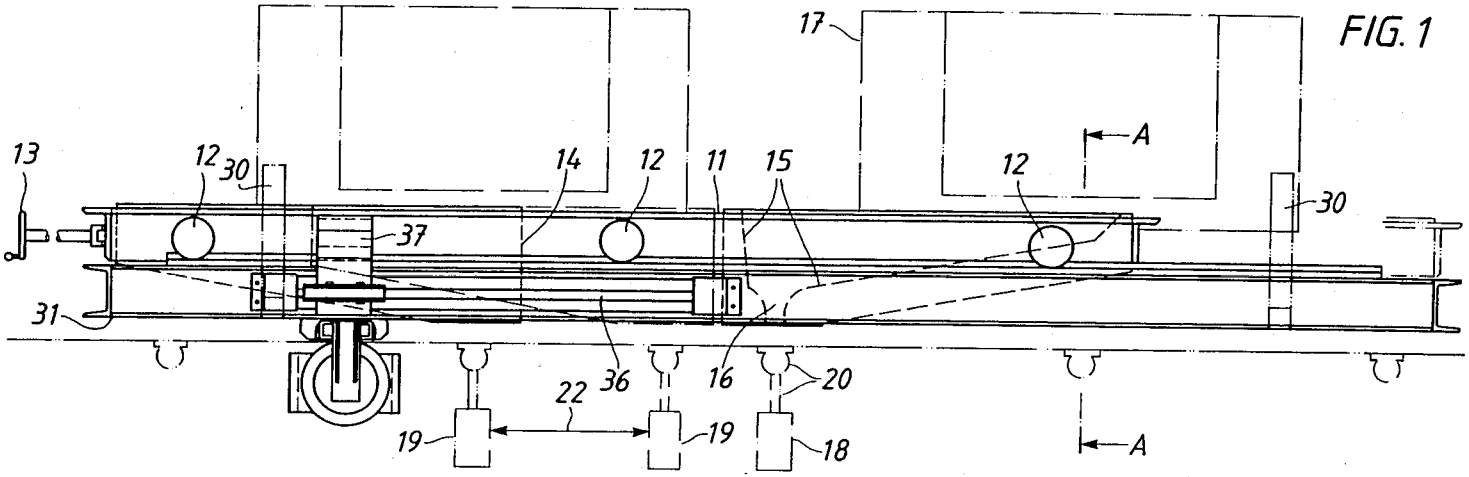
FIG. 1 shows a casting line seen from the side.
Figure 2:
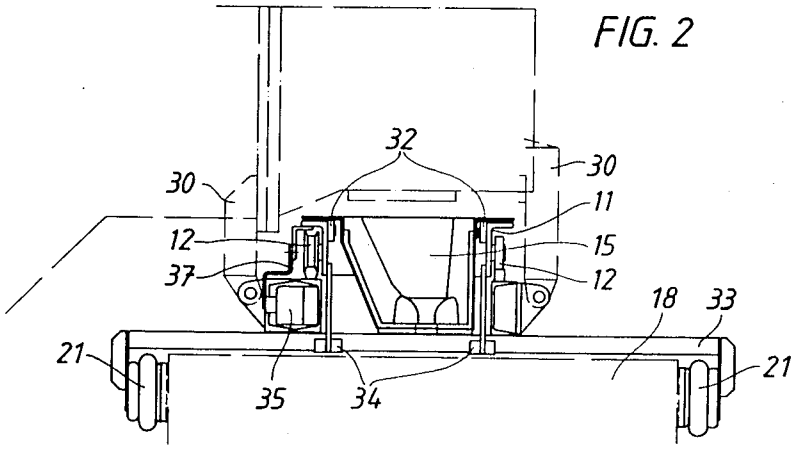
FIG. 2 shows a section on A—A in FIG. 1.

FIGS. 1 and 2 show casting apparatus comprising a furnace for molten metal having two spouts 17 for casting the molten metal into casting moulds (two of which) have been shown and are numbered 18 and 19) arranged in a casting line. Suspended from the spouts 17 by arms 30 is a track device 31 on which there is mounted a carriage 11 for movement backwards and forwards along the track device 31. To enable this backwards and forwards movement the carriage 11 is provided with roll pairs 12.

The carriage 11 carries two melt transfer devices or gutters 14 and 15 which are movable beneath tap openings (not shown) of the spouts 17 during movement of the carriage 11. At least one of the gutters 14, 15 is adjustably mounted on the carriage 11 to enable the distance between the two gutters in the longitudinal direction of the track device 31 to be adjusted. In the illustrated embodiment, the gutter 14 is adjustably mounted relative to the gutter 15 and to this end an adjusting wheel 13 is provided for adjusting the longitudinal position of the gutter 14 within the carriage 11. Suitably the wheel 13 turns a lead-screw connected to the gutter 14 and the latter runs on wheels 32 mounted on the carriage 11 as the lead-screw is turned to adjust the carriage position of the gutter 14. In FIG. 1 two limit positions for the gutter 14 are shown, a leftmost position being shown in dashed lines and a rightmost position being shown in chain lines. The gutter 14 can also be adjustably positioned between the two limit positions, as indicated by double arrow 22, in dependence on the position of the casting mould 19. Each gutter 14, 15 is provided with a tap hole 16 (only shown in gutter 15) and the adjustable positioning of at least one of the two gutters within the carriage 11 enables the tap holes 16 of the gutters 14 and 15 to be fitted into sprues 20 of the casting moulds 18 and 19, respectively.

The casting moulds are arranged to move along the casting line and the carriage 11 is arranged to move forwards along the track device 31 at the same rate as the casting moulds during a casting operation. This is achieved by spaced apart carrier means 21 mounted on a cross member 33 and arranged to grip one of the casting moulds 18 (see FIG. 2). The furnace and track device 31 are adjustably slidably positionable along the cross member 33, with the aid of shoes 34 arranged on either side of the cross member 33, to enable adjustment of the position of the furnace in the transverse direction of the casting line.

Return movement of the carriage 11 (i.e. backwards along the track device 31) is provided by a cylinder 35 arranged to drive the carriage 11 back to its initial position. 36 designates a guide groove, 31 a track device and 37 nut means fixed to carriage 11.

In use, casting of molten metal is arranged to take place during movement of the casting moulds along the casting line. In particular with reference to the drawing, the spaced apart carrier means 21 are operated to grip the casting mould 18 when the carriage 11 is in its leftmost position (as shown in full lines in FIG. 1). During movement of the casting mould 18 along the casting line, the grip provided by the carrier means 21 also moves the carriage 11 forwardly with the mould 18 and actual casting takes place with molten metal being tapped from the furnace spouts 17, via the melt transfer devices or gutters 14 and 15 into two separate casting moulds 18 and 19 via the sprues 20. When the carriage 11 *reaches its right-most end position (shown in chain lines at the right-hand end of FIG. 1), the carrier means* 21 release their grip on the mould 18 and the motor 35 is operated to return the carriage 11 to its left-most position in readiness for enabling casting molten metal into the following two casting moulds in the casting line. Tapping of the melt into the casting moulds will normally cease by the time the carriage 11 reaches its right-most end position. However, casting can possibly be achived during part of a period of rest of the carriage 11 before it is returned to its starting position.

Depending on the relative positions of the casting moulds in the casting line, the relative longitudinal positions of the gutters 14 and 15 and the transverse postion of the furnace can be adjusted as previously described.

In the case of an indexed casting line, casting of casting moulds is performed during part of a period of rest, during subsequent movement of the casting moulds along the casting line and during the major part of the next period of rest of the casting moulds.

The casting line may be straight or curved, e.g. in a circle as disclosed in the U.S. Pat. No. 1,156,446, issued to Taylor and Miley.

Casting apparatus according to the foregoing description can be varied in many ways within the scope of the following claims.

We claim:

1. Casting apparatus for simultaneously casting at least two casting mould means arranged to move in a casting line, each casting mould means having a sprue, wherein the casting apparatus comprises:

a furnace for containing molten metal and provided with two furnace spouts;

support means arranged beneath said furnace spouts;

carriage means supported by the support means and movably mounted thereon for movement in the direction of the casting line, the carriage means carrying two melt transfer devices for transferring molten metal from the two furnace spouts to respective sprues of two casting mould means in the casting line;

adjustment means for adjusting the longitudinal position of at least one of the melt transfer devices relative to the carriage means; and moving means for moving the carriage means and the melt transfer device relative to the support means forwards along the casting line together with forwardly moving casting mould means during a casting operation and backwards along the casting line in readiness for another casting operation.

2. Casting apparatus according to claim 1, wherein the moving means includes clamping means for attaching the carriage means to a casting mould means moving along the casting line to achieve the forward movement of the carriage means.

3. Casting apparatus according to claim 2, wherein the moving means further includes drive means for providing said backwards movement of the carriage means when the latter is not attached to a casting mould means by said clamping means.

4. Casting apparatus for simultaneously supplying melt to two casting mould means which are arranged to move along a casting line, each casting mould means including an upwardly-extending sprue, said casting apparatus including a furnace for containing molten melt, said furnace including a plurality of furnace spouts, an elongated support means attached to said furnace spouts so as to be located therebelow and aligned in parallel with said casting line, an elongated carriage means supported by said support means and movable therealong in parallel with said casting line, two melt transfer devices supported by said elongated carriage means, said two melt transfer devices being capable of transferring molten melt from respective furnace spouts to respective sprues of two casting mould means, at least one of said two melt transfer devices being movable along the length of said elongated carriage means, adjustment means for adjusting the position of one of said two melt transfer devices relative to the other of said melt transfer devices along the length of said elongated carriage means, and a carrier means which is attachable to a casting mould and to said elongated carriage means to move the elongated carriage means along the elongated support means as the casting mould is moved along said casting line.

5. Casting apparatus according to claim 4, wherein said support means includes an elongated track device and arms which extend from said elongated track device up to said furnace spouts.

6. Casting apparatus according to claim 4, wherein said furnace is movable in a transverse direction in relation to the casting line.

* * * * *